US010008834B2

(12) United States Patent
Kimura et al.

(10) Patent No.: US 10,008,834 B2
(45) Date of Patent: Jun. 26, 2018

(54) METHOD FOR MANUFACTURING SPARK PLUG

(71) Applicant: NGK SPARK PLUG CO., LTD., Nagoya-shi, Aichi (JP)

(72) Inventors: Junji Kimura, Ichinomiya (JP); Keiji Ozeki, Konan (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days. days.

(21) Appl. No.: 15/214,505

(22) Filed: Jul. 20, 2016

(65) Prior Publication Data

US 2017/0025823 A1 Jan. 26, 2017

(30) Foreign Application Priority Data

Jul. 21, 2015 (JP) ..... 2015-143952

(51) Int. Cl.

| | |
|---|---|
| ***H01T 13/60*** | (2011.01) |
| ***H01T 13/34*** | (2006.01) |
| ***H01T 13/58*** | (2011.01) |
| ***H01T 21/02*** | (2006.01) |

(52) U.S. Cl.

CPC ..... *H01T 13/60* (2013.01); *H01T 13/34* (2013.01); *H01T 13/58* (2013.01); *H01T 21/02* (2013.01)

(58) Field of Classification Search

CPC ..... H01T 13/60; H01T 13/58; H01T 21/02
USPC ..... 445/3
See application file for complete search history.

(56) References Cited

U.S. PATENT DOCUMENTS

| | | | | |
|---|---|---|---|---|
| 5,055,772 | A * | 10/1991 | Piejak | F02P 17/12 324/122 |
| 2009/0224767 | A1 | 9/2009 | Honda et al. | 324/400 |
| 2013/0337717 | A1 | 12/2013 | Hirose et al. | 445/3 |
| 2014/0141679 | A1 | 5/2014 | Kyuno | 445/3 |

FOREIGN PATENT DOCUMENTS

| | | | | |
|---|---|---|---|---|
| EP | 2 869 413 | A1 | 5/2015 | H01T 13/60 |
| JP | 2007-134132 | A | 5/2007 | G01R 31/12 |
| JP | 2012-185963 | A | 9/2012 | H01T 13/36 |
| JP | 5409061 | B2 | 2/2014 | F02P 13/00 |
| JP | 2015-088436 | A | 5/2015 | H01T 13/60 |

OTHER PUBLICATIONS

Extended European Search Report and Written Opinion issued in related European Application No. 16180599.9 dated Dec. 22, 2016. Office Action received in corresponding Japanese Patent Application No. 2015-143952, dated May 23, 2017 (English translation provided).

* cited by examiner

*Primary Examiner* — Christopher Raabe
(74) *Attorney, Agent, or Firm* — Kusner & Jaffe

(57) ABSTRACT

A method for manufacturing a spark plug comprising the steps of: placing an assembly of the center electrode, an insulator, and a metal shell in a pressure resistant vessel and determining whether or not the insulator has a defect by applying a voltage to the center electrode, and bending the ground electrode toward the center electrode after the defect inspection step, the defect inspection step being performed while a pressure in the pressure resistant vessel is changed to a plurality of different pressures.

4 Claims, 9 Drawing Sheets

FIG. 7

| PLUG SPECIFICATION | No. | PRESSURE FIXED (MPa) | | | | | | | | | | | | | | | | | | | | PRESSURE CHANGED (MPa) | |
|---|---|---|---|---|---|---|---|---|---|---|---|---|---|---|---|---|---|---|---|---|---|---|---|
| | | 0.2 | 0.4 | 0.6 | 0.8 | 1.0 | 1.2 | 1.4 | 1.6 | 1.8 | 2.0 | 2.2 | 2.4 | 2.6 | 2.8 | 3.0 | 3.2 | 3.4 | 3.6 | 3.8 | 4.0 | 4→0.3 | 0.3→4 |
| TYPE A | 1 | × | × | ○ | ○ | × | × | ○ | ○ | ○ | × | × | × | × | ○ | × | × | × | × | × | × | ○ | ○ |
| | 2 | × | × | × | × | × | × | × | × | × | ○ | × | × | × | ○ | × | × | × | × | × | × | ○ | ○ |
| | 3 | × | × | ○ | × | × | × | × | × | × | × | × | ○ | × | ○ | × | × | × | × | × | × | ○ | ○ |
| TYPE B | 1 | × | ○ | × | × | × | ○ | × | × | ○ | ○ | ○ | × | × | × | × | ○ | ○ | × | × | × | ○ | ○ |
| | 2 | × | × | × | × | × | × | × | × | × | × | × | × | × | × | × | × | ○ | × | ○ | × | ○ | ○ |
| | 3 | × | × | × | × | × | ○ | × | ○ | × | × | × | × | × | × | × | × | × | × | × | × | ○ | ○ |

○ : DEFECT DETECTION OK
× : DEFECT DETECTION NG

METHOD FOR MANUFACTURING SPARK PLUG

RELATED APPLICATIONS

This application claims the benefit of Japanese Patent Application No. 2015-143952, filed Jul. 21, 2015, the entire contents of which are incorporated herein by reference.

FIELD OF THE INVENTION

The present invention relates to a method for manufacturing a spark plug.

BACKGROUND OF THE INVENTION

Spark plugs are attached to, for example, internal combustion engines and used to ignite an air-fuel mixture in combustion chambers. A spark plug generally includes an insulator having an axial hole that extends therethrough in an axial direction, a center electrode disposed in the axial hole of the insulator, and a metal shell that is provided on the outer periphery of the insulator and provided with a ground electrode. The spark plug ignites the air-fuel mixture by causing a spark discharge between the center electrode and the ground electrode.

When the spark plug has a through hole that extends through the insulator in a thickness direction thereof, there is a possibility that the insulation between the center electrode and the metal shell will be insufficient. As a result, when a high voltage is applied to the center electrode, a discharge through the insulator (also referred to as a "through discharge") may occur between the center electrode and the metal shell. When the through discharge occurs, there is a possibility that a spark discharge will not occur between the center electrode and the ground electrode. Accordingly, Japanese Unexamined Patent Application Publication No. 2012-185963 proposes a method of determining whether or not the insulator has a defect, such as a through hole, by applying a high voltage to the center electrode in a high-pressure atmosphere.

However, the inventors of the present invention have found that there may be a case where no through discharge occurs in a high-pressure atmosphere even when the insulator has a through hole. In this case, it is difficult to reliably determine whether or not the insulator has a defect by using the technology described in Japanese Unexamined Patent Application Publication No. 2012-185963. Accordingly, there has been a demand for a technology for reliably determining whether or not the insulator has a defect.

SUMMARY OF THE INVENTION

The present invention has been made to address the above-described problem, and may be embodied in the following forms.

(1) In accordance with a first aspect of the present invention, there is provided a method for manufacturing a spark plug is provided. The spark plug includes an insulator having an axial hole that extends through the insulator in a direction of an axial line; a center electrode disposed in the axial hole in such a manner that a distal end of the center electrode projects from a distal portion of the insulator; and a metal shell that is provided on an outer periphery of the insulator so as to cover a periphery of at least a portion of the insulator and that includes a distal portion to which a ground electrode is bonded. The method includes a defect inspection step of placing an assembly of the center electrode, the insulator, and the metal shell in a pressure resistant vessel and determining whether or not the insulator has a defect by applying a voltage to the center electrode; and a bending step of bending the ground electrode toward the center electrode after the defect inspection step. The defect inspection step is performed while a pressure in the pressure resistant vessel is changed to a plurality of different pressures. With the method for manufacturing the spark plug according to this aspect, even in a spark plug in which the insulator does not cause a through discharge when the pressure in the pressure resistant vessel is set to a specific pressure, whether or not the insulator has a defect can be reliably determined by performing the defect inspection step while changing the pressure in the pressure resistant vessel to a plurality of different pressures.

(2) In accordance with a second aspect of the present invention, there is provided a method for manufacturing the spark plug according to the above-described aspect, wherein the defect inspection step may be performed in an atmosphere containing at least one or more inert gases. With this method for manufacturing the spark plug, whether or not the insulator has a defect can be more reliably determined.

(3) In accordance with a third aspect of the present invention, there is provided a method for manufacturing the spark plug according to the above-described aspect, wherein the defect inspection step may be a step in which it is determined whether or not the assembly has a predetermined voltage resistance by applying the voltage to the center electrode while the pressure in the pressure resistant vessel is such that a differentiated value obtained by differentiating the voltage with respect to time is lower than or equal to a threshold, and then the voltage is reduced and it is determined whether or not the insulator has a defect. With this method for manufacturing the spark plug, whether or not the insulator has a defect can be reliably determined, and the voltage resistance of the spark plug can also be determined.

(4) In accordance with a fourth aspect of the present invention, there is provided a method for manufacturing the spark plug according to the above-described aspect, wherein the defect inspection step may be performed while a humidity in the pressure resistant vessel is higher than or equal to a predetermined value. With this method for manufacturing the spark plug, whether or not the insulator has a defect can be more reliably determined.

The present invention may be embodied in various forms, such as a method for determining whether an insulator has a defect.

BRIEF DESCRIPTION OF THE DRAWINGS

FIG. 7 is a table showing the results of experiments for determining whether or not a defect can be detected in the cases where the pressure is fixed and changed;

DETAILED DESCRIPTION OF THE PREFERRED EMBODIMENTS

A. First Embodiment

A1. Structure of Spark Plug

Figure 1:
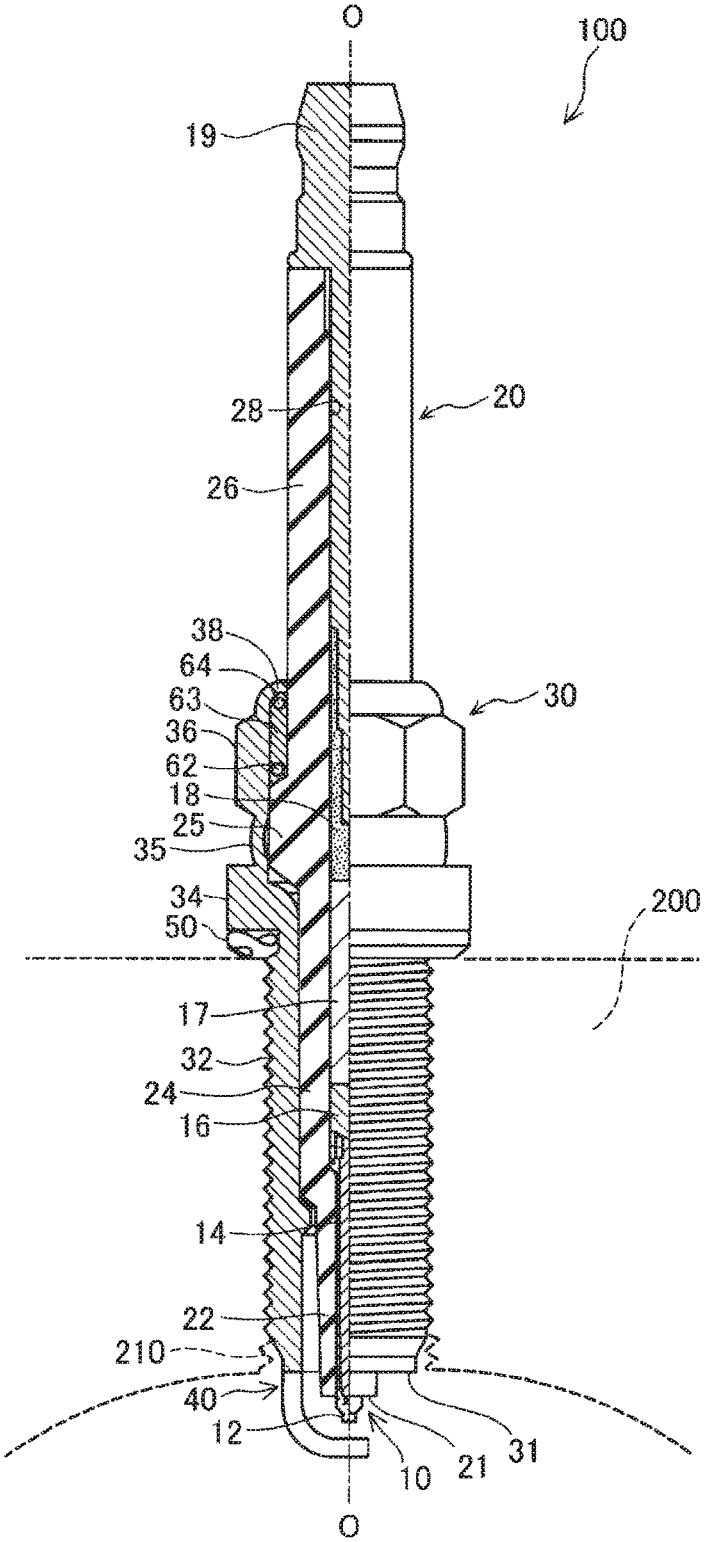
FIG. 1 is a partially sectioned view of a spark plug.

FIG. 1 is a partially sectioned view of a spark plug 100. In FIG. 1, the external appearance of the spark plug 100 is shown on one side of an axial line O-O, which is the axial center of the spark plug 100, and a cross section of the spark plug 100 is shown on the other side. The lower side of FIG. 1 is referred to as a distal side, and the upper side of FIG. 1 is referred to as a proximal side.

The spark plug 100 includes (i) an insulator 20 having an axial hole 28 that extends therethrough in the direction of the axial line O-O; (ii) a center electrode 10 disposed in the axial hole 28 in such a manner that a distal end thereof projects from a distal portion 21 of the insulator 20; and (iii) a metal shell 30 that is provided on the outer periphery of the insulator 20 so as to cover the periphery of at least a portion of the insulator 20 and that includes a distal portion to which a ground electrode 40 is bonded. In the present embodiment, the axial line O-O of the spark plug 100 is also the axial center of each of the center electrode 10, the insulator 20, and the metal shell 30.

In the spark plug 100, the metal shell 30 is fixed to the outer periphery of the insulator 20 by a crimping process in such a manner that the metal shell 30 is electrically insulated from the center electrode 10. The ground electrode 40 is electrically connected to the metal shell 30. A spark gap, which is a gap in which a spark is generated, is formed between the center electrode 10 and the ground electrode 40. The spark plug 100 is attached to an engine head 200 of an internal combustion engine (not shown) by screwing the metal shell 30 into a threaded attachment hole 210 formed in the engine head 200. When a high voltage of twenty to thirty thousand volts is applied to the center electrode 10, a spark is generated in the spark gap between the center electrode 10 and the ground electrode 40.

The center electrode 10 of the spark plug 100 is a rod-shaped electrode obtained by embedding a core material 14 into an electrode base material 12 having a cylindrical shape with a bottom. The core material 14 has a thermal conductivity higher than that of the electrode base material 12. In the present embodiment, the center electrode 10 is fixed to the insulator 20 in such a manner that the distal end of the electrode base material 12 projects from the distal end of the insulator 20. The center electrode 10 is electrically connected to a terminal 19 by a first sealing layer 16, a resistor 17, and a second sealing layer 18, which are arranged in that order. In the present embodiment, the electrode base material 12 of the center electrode 10 is made of a nickel alloy containing nickel as the main component, such as Inconel (registered trademark). The core material 14 of the center electrode 10 is made of copper or an alloy containing copper as the main component.

The first sealing layer 16 fixes the insulator 20 and the center electrode 10 to each other in a sealed state, and the second sealing layer 18 fixes the insulator 20 and the terminal 19 in a sealed state. In the present embodiment, the resistor 17 is referred to also as a "ceramic resistor," and is mainly composed of a conductive material, glass particles, and ceramic particles other than glass particles. The first sealing layer 16 and the second sealing layer 18 are made of glass in which metal powder is mixed, the metal powder containing one, two, or more metal components, such as Cu, Sn, and Fe, as the main components. An adequate amount of semiconductive inorganic compound powder, such as $TiO_2$ powder, may also be contained in the material of the first sealing layer 16 and the second sealing layer 18 as necessary.

The insulator 20 of the spark plug 100 is formed by sintering an insulating ceramic material, such as alumina. The insulator 20 is a cylindrical member having the axial hole 28 that receives the center electrode 10, and includes the distal portion 21, a leg portion 22, a first insulator body portion 24, an insulator flange portion 25, and a second insulator body portion 26 arranged in that order along the axial line O-O from the side at which the center electrode 10 projects. The distal portion 21 of the insulator 20 is an annular portion formed at the distal end of the insulator 20. The leg portion 22 of the insulator 20 is a cylindrical portion having an outer diameter that decreases toward the side at which the center electrode 10 projects. The first insulator body portion 24 of the insulator 20 is a cylindrical portion having an outer diameter greater than that of the leg portion 22. The insulator flange portion 25 of the insulator 20 is a cylindrical portion having an outer diameter greater than that of the first insulator body portion 24. The second insulator body portion 26 of the insulator 20 is a cylindrical portion having an outer diameter smaller than that of the insulator flange portion 25.

In the present embodiment, the metal shell 30 of the spark plug 100 is made of nickel-plated low-carbon steel. However, in another embodiment, the metal shell 30 may instead be made of zinc-plated low carbon steel, or a non-plated nickel alloy. The metal shell 30 includes an end surface 31, a threaded portion 32, a body portion 34, a groove portion 35, a tool engagement portion 36, and a crimping portion 38 arranged in that order along the axial line O-O from the side at which the center electrode 10 projects.

The end surface 31 of the metal shell 30 is an annular surface formed at the distal end of the threaded portion 32. The ground electrode 40 is bonded to the end surface 31, and the center electrode 10 surrounded by the leg portion 22 of the insulator 20 projects from the center of the end surface 31. The threaded portion 32 of the metal shell 30 is a portion of the outer periphery of the metal shell 30, and has a screw groove that engages with the threaded attachment hole 210 in the engine head 200. The body portion 34 of the metal shell 30 is disposed adjacent to the groove portion 35, and is flange-shaped so as to protrude radially outward from the groove portion 35. An annular gasket 50 formed by bending a plate is disposed between the threaded portion 32 and the body portion 34. The body portion 34 seals the threaded attachment hole 210 in the engine head 200 with the gasket 50 interposed therebetween. Accordingly, leakage of the air-fuel mixture from the engine through the threaded attachment hole 210 can be prevented.

The groove portion 35 of the metal shell 30 is disposed between the body portion 34 and the tool engagement portion 36. When the metal shell 30 is fixed to the insulator 20 by a crimping process, the groove portion 35 is compressed so as to bulge radially outward and inward. The tool engagement portion 36 of the metal shell 30 is disposed adjacent to the groove portion 35, and is flange-shaped so as to protrude radially outward from the groove portion 35. The tool engagement portion 36 has a polygonal shape so as to be engageable with a tool (not shown) used to attach the spark plug 100 to the engine head 200. In the present embodiment, the tool engagement portion 36 has a hexagonal shape. However, in another embodiment, the tool engagement portion 36 may instead have a rectangular shape, an octagonal shape, or another polygonal shape. The crimping portion 38 of the metal shell 30 is disposed adjacent to the tool engagement portion 36. The crimping portion 38 is plastically deformed so as to come into close contact with the second insulator body portion 26 of the insulator 20 when the metal shell 30 is fixed to the insulator 20 by the crimping process. A filling portion 63 that is filled with talc powder is formed between the crimping portion 38 of the metal shell 30 and the insulator flange portion 25 of the insulator 20. The filling portion 63 is sealed with packings 62 and 64.

The ground electrode 40 of the spark plug 100 is welded to the metal shell 30, and is bent in a direction that crosses the axial line O-O of the center electrode 10 so as to face the distal end of the center electrode 10. In the present embodiment, the ground electrode 40 is made of a nickel alloy containing nickel as the main component, such as Inconel (registered trademark).

A2. Method for Manufacturing Spark Plug 100

Figure 2:
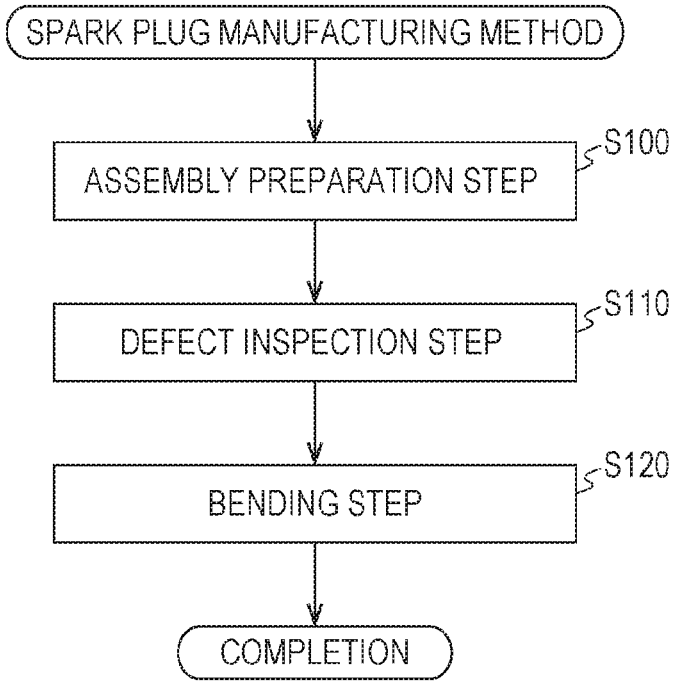
FIG. 2 is a flowchart of a method for manufacturing the spark plug.

FIG. 2 is a flowchart of a method for manufacturing the spark plug 100. First, a manufacturer performs an assembly preparation step (step S100). In the assembly preparation step, an assembly 100A of the center electrode 10, the insulator 20, and the metal shell 30 is prepared. The assembly 100A prepared in step S100 is the same as the spark plug 100, which is a completed product, except that the ground electrode 40 is not bent and extends toward the distal side.

Next, the manufacturer performs a defect inspection step (step S110). In the defect inspection step, the assembly 100A is placed in a pressure resistant vessel 300 and it is determined whether or not the insulator 20 has a defect by applying a voltage to the center electrode 10.

Figure 3:
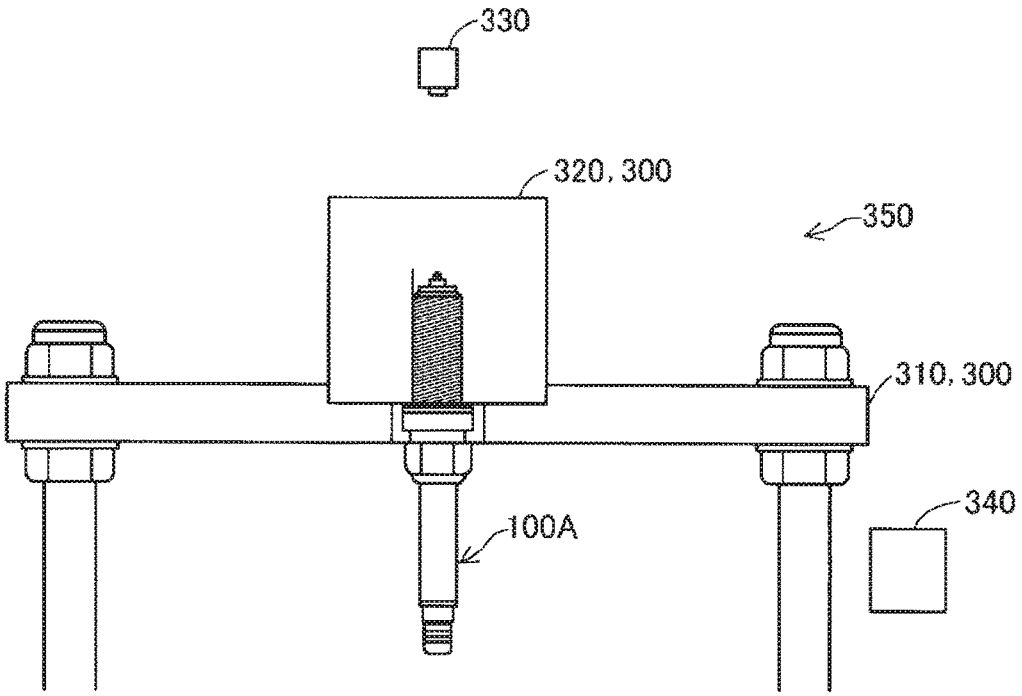
FIG. 3 is a diagram for describing a defect inspection step.

FIG. 3 is a diagram for describing the defect inspection step. FIG. 3 shows the state in which the assembly 100A is disposed in the pressure resistant vessel 300 of a defect inspection apparatus 350. The defect inspection apparatus 350 includes the pressure resistant vessel 300, an imaging device 330, and a processing device 340 that controls components of the defect inspection apparatus. The pressure resistant vessel 300 includes a table 310 and a casing 320.

The table 310 has a through hole, and the assembly 100A is attached to the pressure resistant vessel 300 by inserting the assembly 100A into the through hole. The casing 320 is a pressure resistant container. The casing 320 is filled with air, and the pressure in the casing 320 is adjusted by a pressure adjusting device (not shown). A method for determining whether or not a discharge has occurred will now be described.

Figure 4A:
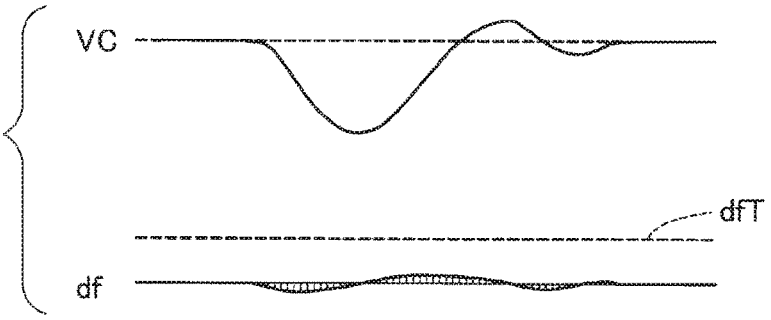
FIGS. 4A and 4B are graphs showing the relationships between the applied voltage and the value obtained by differentiating the applied voltage with respect to time.
Figure 4B:
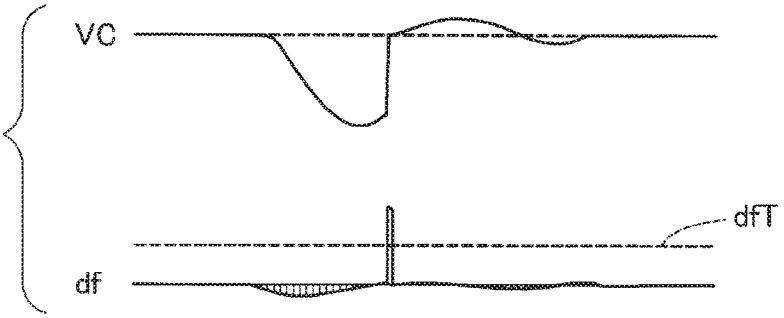

FIGS. 4A and 4B are graphs showing the relationships between a voltage VC applied to the center electrode 10 and a differentiated value df obtained by differentiating the applied voltage VC with respect to time. In each of FIGS. 4A and 4B, the vertical axis of the upper graph represents the applied voltage VC, and the vertical axis of the lower graph represents the differentiated value df obtained by differentiating the applied voltage VC with respect to time. In each of FIGS. 4A and 4B, the horizontal axes represent time. In the case where a voltage is applied to the center electrode 10, when a discharge (flash over or through discharge) does not occur between the center electrode 10 and the metal shell 30, the voltage VC applied to the center electrode 10 relatively smoothly varies, as illustrated in FIG. 4A. Therefore, the absolute value of the differentiated value df obtained by differentiating the applied voltage VC with respect to time is relatively small. The waveform of the applied voltage VC obtained when a discharge (flash over or through discharge) does not occur between the center electrode 10 and the metal shell 30 in the case where the voltage is applied to the center electrode 10 is referred to as a "performance waveform."

In the case where the voltage is applied to the center electrode 10, when a discharge (flash over or through discharge) occurs between the center electrode 10 and the metal shell 30, the voltage VC applied to the center electrode 10 suddenly changes, as illustrated in FIG. 4B. Therefore, the absolute value of the differentiated value df obtained by differentiating the applied voltage VC with respect to time is relatively large. In the present embodiment, the processing device 340 determines that a discharge has occurred when the differentiated value df is greater than a threshold dfT, and that a discharge has not occurred when the differentiated value df is lower than or equal to the threshold dfT. A method for determining whether the discharge is a flash over or a through discharge will now be described.

The imaging device 330 is disposed above the casing 320 (see FIG. 3). The imaging device 330 is controlled by the processing device 340 so as to acquire an image at the time when a discharge occurs in the assembly 100A. The imaging device 330 captures an image of an area including at least the center electrode 10 and the insulator 20 viewed from the distal side in the direction of the axial line O-O. In the present embodiment, a CCD camera is used as the imaging device 330. The imaging device 330 starts an imaging process when the application of the voltage to the center electrode 10 is started. The time for which the imaging device 330 performs the imaging process is set so as to be sufficiently longer than the time for which the voltage is applied to the center electrode 10. Therefore, the voltage is applied to the center electrode 10 during the imaging process, and the imaging device 330 can perform the imaging process on the assembly 100A while the voltage is being applied to the center electrode 10 irrespective of the occurrence of a discharge.

The processing device 340 determines whether or not an electrical breakdown (through discharge) has occurred in the insulator 20 on the basis of the image captured by the imaging device 330. In other words, the processing device 340 determines whether a discharge that has occurred between the center electrode 10 and the metal shell 30 is a flash over (discharge that does not penetrate the insulator 20) or a through discharge (discharge that penetrates the insulator 20).

More specifically, the processing device 340 binarizes a portion of the captured image including the insulator 20 by comparing the brightness of each pixel included in that portion with a preset threshold BT, and thereby obtains a binarized image. The processing device 340 calculates the centroid coordinates of a part of the binarized image having the higher brightness, and determines whether or not a through discharge has occurred based on the calculated centroid coordinates.

Figure 5A:
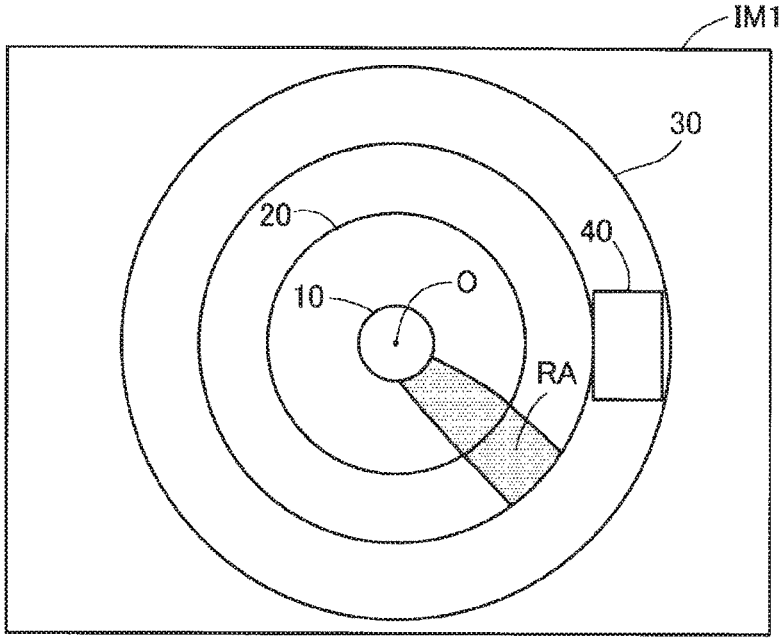
FIGS. 5A and 5B illustrate images obtained in the case where a flash over has occurred.
Figure 5B:
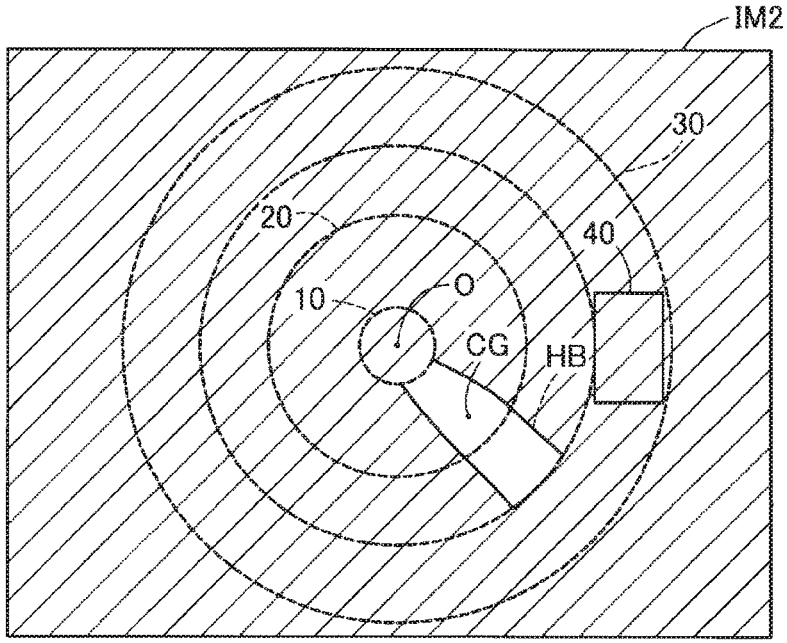

FIGS. 5A and 5B illustrate images IM1 and IM2 obtained in the case where a flash over has occurred. FIG. 5A illustrates the captured image IM1, and FIG. 5B illustrates the binarized image IM2 obtained by binarizing the captured image IM1. As illustrated in FIG. 5A, a high-brightness portion RA of the captured image IM1 extends from a region in which the center electrode 10 is located to a region in which the inner periphery of the metal shell 30 is located. As illustrated in FIG. 5B, also in the binarized image obtained by binarizing the captured image IM1, a high-brightness portion HB extends from the region in which the center electrode 10 is located to the region in which the inner periphery of the metal shell 30 is located. Thus, the position of the centroid coordinates CG of the high-brightness portion HB is relatively close to the center of the center electrode 10, and is on the insulator 20.

Figure 6A:
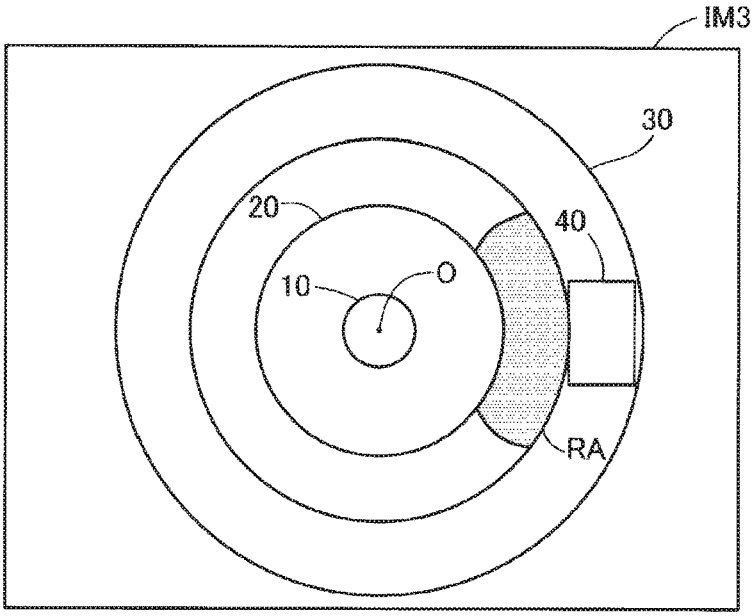
FIGS. 6A and 6B illustrate images obtained in the case where a through discharge has occurred.
Figure 6B:
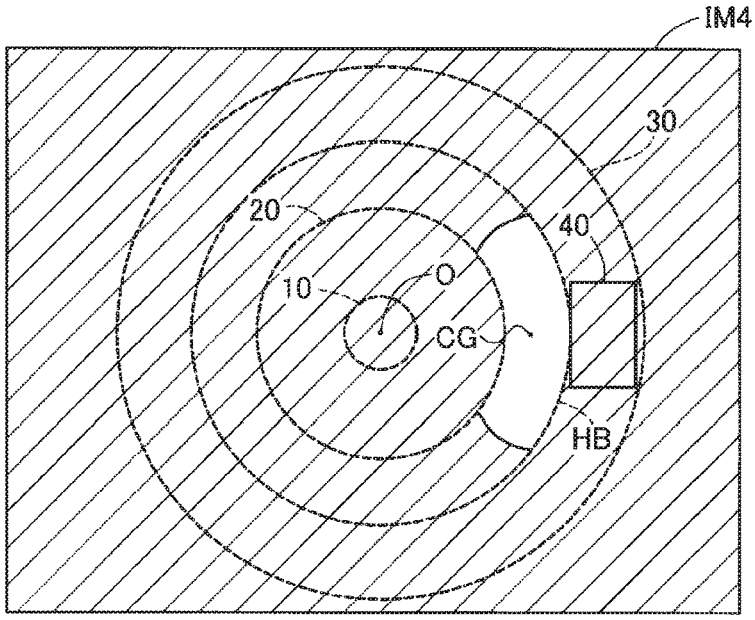

FIGS. 6A and 6B illustrate images IM3 and IM4 obtained in the case where a through discharge has occurred. FIG. 6A illustrates the captured image IM3, and FIG. 6B illustrates the binarized image IM4 obtained by binarizing the captured image IM3. As illustrated in FIG. 6A, a high-brightness portion RA of the captured image IM3 extends from a region in which the outer periphery of the insulator 20 is located to a region in which the inner periphery of the metal shell 30 is located. As illustrated in FIG. 6B, also in the binarized image obtained by binarizing the captured image IM3, a high-brightness portion HB extends from the region in which the outer periphery of the insulator 20 is located to the region in which the inner periphery of the metal shell 30 is located. Thus, the position of the centroid coordinates CG of the high-brightness portion HB is relatively far from the center of the center electrode 10, and is in the region extending from the region in which the outer periphery of the insulator 20 is located to the region in which the inner periphery of the metal shell 30 is located.

Based on the above-described tendencies, the processing device 340 determines that a flash over has occurred and that an electrical breakdown of the insulator 20 has not occurred when the position of the centroid coordinates CG of the portion HB is relatively close to the center of the center electrode 10 and is on the insulator 20 (for example, when the distance from the position of the centroid coordinates CG to the axial line O-O is smaller than or equal to a predetermined value). The processing device 340 determines that a through discharge has occurred and that an electrical breakdown of the insulator 20 has occurred when the position of the centroid coordinates CG of the portion HB is relatively far from the center of the center electrode 10 and is in a region extending from the outer periphery of the insulator 20 to the inner periphery of the metal shell 30 (for example, when the distance from the position of the centroid coordinates CG to the axial line O-O is greater than the predetermined value).

In the present embodiment, the defect inspection step (step S110) is performed while the pressure in the pressure resistant vessel 300 is changed to a plurality of different pressures. More specifically, the manufacturer increases (or reduces) the pressure in the pressure resistant vessel 300 while applying a voltage to the center electrode 10 a plurality of times at regular intervals. Accordingly, even when the assembly 100A does not cause a through discharge at a certain pressure, whether or not the insulator has a defect can be determined by performing the inspection while changing the pressure in the pressure resistant vessel to a plurality of different pressures.

After the defect inspection step (step S110), the manufacturer performs a bending step (step S120). In the bending step, the ground electrode 40 is bent toward the center electrode 10. The spark plug 100 is completed by the above-described steps.

A3. Experiment Results

FIG. 7 is a table showing the results of experiments for determining whether or not a defect can be detected in the cases where the pressure is fixed and changed. Two types of spark plugs, types A and B, were prepared. Type A spark plugs are spark plugs ignited at a normal voltage, and type B spark plugs are spark plugs ignited at a higher voltage than the type A spark plugs. Thus, types A and B are different. The experimenter prepared three spark plugs of each type, and made small through holes in the insulators of the prepared spark plugs in advance. The small through holes were formed by intentionally causing a through discharge by applying a high voltage to the center electrode 10 while the pressure in the pressure resistant vessel was set to a high pressure. Thus, FIG. 7 shows the results of experiments for determining whether or not the spark plugs having small through holes can be determined as being defective.

In FIG. 7, "O" represents "defect detection OK", which means that a through discharge occurred when a voltage of 35 kV was applied to the center electrode 10 nine hundred times, and "X" represents "defect detection NG", which means that no through discharge occurred. FIG. 7 shows the results for both of the cases where the pressure in the pressure resistant vessel was fixed and changed. In the case where the pressure in the pressure resistant vessel was changed, "4→0.3" in FIG. 7 means that the voltage was applied while the pressure was set to 4 MPa for the first 300 times, while the pressure was reduced from 4 MPa to 0.3 MPa for the next 150 times, and while the pressure was set to 0.3 MPa for the last 450 times. Also, in the case where the pressure in the pressure resistant vessel was changed, "0.3→4" in FIG. 7 means that the voltage was applied while the pressure was set to 0.3 MPa for the first 450 times, while the pressure was increased from 0.3 MPa to 4 MPa for the next 150 times, and while the pressure was set to 4 MPa for the last 300 times.

The results of FIG. 7 show that a through discharge was detected for all of the six spark plugs when the pressure in the pressure resistant vessel was changed, and that a through discharge was not detected for at least one of the spark plugs when the pressure in the pressure resistant vessel was fixed. The results confirmed that whether or not the insulator has a defect can be reliably determined by performing the defect inspection while changing the voltage in the pressure resistant vessel to a plurality of different voltages. This is probably because a through discharge occurs at different pressures depending on the state of the defect (through hole) in the insulator, and even when no through discharge occurs at a certain pressure, a through discharge occurs at a different pressure when the pressure in the pressure resistant vessel is changed. Accordingly, whether or not the insulator has a defect can be reliably determined.

B. Second Embodiment

B1. Method for Manufacturing Spark Plug 100

A second embodiment is the same as the first embodiment except for the defect inspection step (step S110). More specifically, a defect inspection step (step S110A) according to the second embodiment is performed in an atmosphere containing at least one or more inert gases.

B2. Experiment Results

Figure 8:
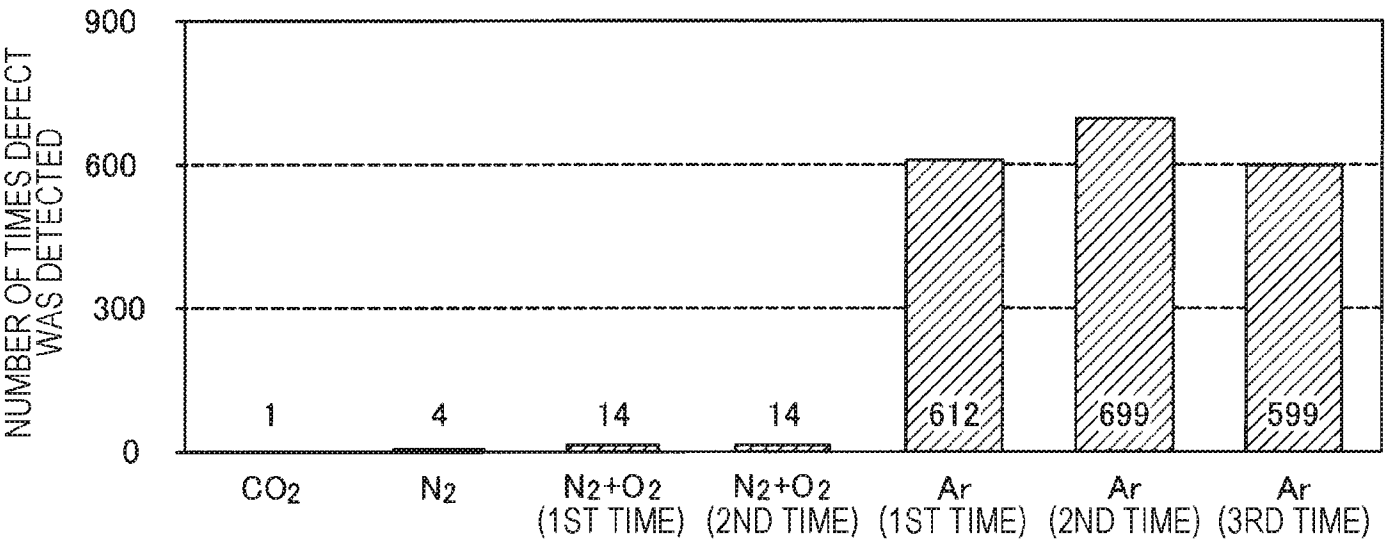
FIG. 8 is a graph showing the results of experiments for determining whether or not a defect can be detected in the case where gas contained in a casing is changed.

FIG. 8 is a graph showing the results of experiments for determining whether or not a defect can be detected in the cases where the gas in the casing 320 is changed. In FIG. 8, the gas in the casing 320 was (i) carbon dioxide ($CO_2$), (ii) nitrogen ($N_2$), (iii) atmospheric gas (nitrogen ($N_2$) and oxygen ($O_2$)), and (iv) argon (Ar) in that order from the left. The experiment was performed twice when the gas in the casing 320 was atmospheric gas, and three times when the gas in the casing 320 was argon (Ar). The result of each experiment is shown in FIG. 8.

An experimenter used the above-described type A spark plugs, and a voltage of 35 kV was applied to the center electrode 10 nine hundred times. The voltage was applied while the pressure was set to 4 MPa for the first 300 times, while the pressure was reduced from 4 MPa to 0.3 MPa for the next 150 times, and while the pressure was set to 0.3 MPa for the last 450 times.

The results of FIG. 8 show that the number of times the defect was detected was greater when the gas in the casing 320 was atmospheric gas or argon (Ar) than when the gas in the casing 320 was carbon dioxide ($CO_2$) or nitrogen ($N_2$). In particular, the number of times the defect was detected was greatest when the gas in the casing 320 was argon (Ar). Argon is generally sealed in, for example, fluorescent tubes, and is used to reduce a discharge voltage. When the gas in the casing 320 is argon, the occurrence of a through discharge is greater than the occurrence of a flash over, and defects can be more reliably detected. Similar results can probably be obtained when other inert gases, such as helium (He) and neon (Ne)), are used.

C. Third Embodiment

C1. Method for Manufacturing Spark Plug 100

A third embodiment is the same as the first embodiment except for the defect inspection step (step S110). More specifically, a defect inspection step (step S110B) according to the third embodiment includes a first step (step S112) and a second step (step S114) performed after the first step S112. In the first step S112, which will be described in detail below, it is determined whether or not the assembly 100A has a predetermined voltage resistance by applying a voltage to the center electrode 10 while the pressure in the pressure resistant vessel 300 is set such that the differentiated value df obtained by differentiating the voltage VC (see FIG. 4) applied to the center electrode 10 with respect to time is lower than or equal to the threshold dfT. In the second step S114, the voltage VC applied to the center electrode 10 is reduced and it is determined whether or not the insulator 20 has a defect. The second step is the same as the defect inspection step (step S110) according to the first embodiment.

Figure 9:
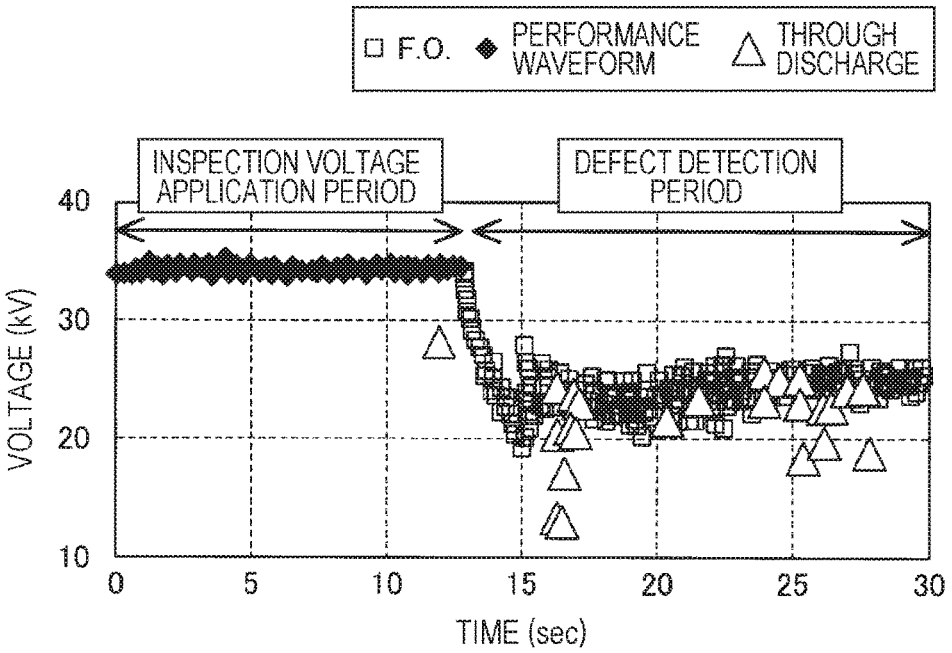
FIG. 9 is a diagram for describing a defect inspection step according to a third embodiment.

FIG. 9 is a diagram for describing the defect inspection step according to the third embodiment. FIG. 9 shows the results of the defect inspection step according to the third embodiment. In the defect inspection step (step S110B), first, the manufacturer performs the first step S112. More specifically, the manufacturer sets the pressure in the pressure resistant vessel 300 such that the differentiated value df obtained by differentiating the applied voltage VC (see FIG. 4) with respect to time is smaller than or equal to the threshold dfT. In other words, the manufacturer sets the pressure in the pressure resistant vessel 300 to a pressure such that no discharge between the center electrode 10 and the metal shell 30 is expected to occur based on the design of the spark plug. In the present embodiment, the pressure in the pressure resistant vessel 300 is set to 4 MPa.

In this state, a voltage is applied to the center electrode 10, and it is determined whether or not the assembly 100A has a predetermined voltage resistance. In FIG. 9, the horizontal axis represents time (sec) and the vertical axis represents voltage (kV). In the present embodiment, a voltage was applied to the center electrode 10 a plurality of times while the pressure in the pressure resistant vessel 300 was fixed to 4 MPa for the first 10 seconds, and then the voltage was applied to the center electrode 10 a plurality of times while the pressure in the pressure resistant vessel 300 was reduced from 4 MPa to 0.3 MPa in the next 5 seconds. Then, the voltage was applied to the center electrode 10 a plurality of times while the pressure in the pressure resistant vessel 300 was fixed to 0.3 MPa for the last 15 seconds.

In FIG. 9, the rectangles indicate the voltage applied to the center electrode 10 when a flash over ("F.O." in FIG. 9) occurred, the triangles indicate the voltage applied to the center electrode 10 when a through discharge occurred, and the rhombuses indicate the voltage applied to the center electrode 10 when no discharge occurred, that is, when the "performance waveform" was generated.

In FIG. 9, the period from 0 to about 13 seconds is a period in which the performance waveform was generated, and is referred to as an "inspection voltage application period." In this period, it is determined whether or not the assembly 100A has a voltage resistance. The period from about 13 to 30 seconds is a period in which a discharge occurs, and is referred to as a "defect detection period." In this period, it is determined whether or not the insulator 20 has a defect. According to this embodiment, whether or not the insulator 20 has a defect can be reliably determined in the defect inspection step (step S110B), and whether or not the assembly 100A has a voltage resistance can also be determined. In the present embodiment, it is determined that the assembly 100A has a voltage resistance when the ratio of occurrence of a flash over in the inspection voltage application period is lower than or equal to a threshold. It is determined that the assembly 100A does not have a voltage resistance when a through discharge occurs in the inspection voltage application period. In the present embodiment, it is determined that the insulator 20 of the assembly 100A does not have a defect when no through discharge occurs in the inspection voltage application period and the defect detection period.

D. Fourth Embodiment

D1. Method for Manufacturing Spark Plug 100

A fourth embodiment is the same as the first embodiment except for the defect inspection step (step S110). More specifically, a defect inspection step (step S110C) according to the fourth embodiment is performed while the humidity in the pressure resistant vessel 300 is higher than or equal to a predetermined value.

D2. Experiment Results

Figure 10:
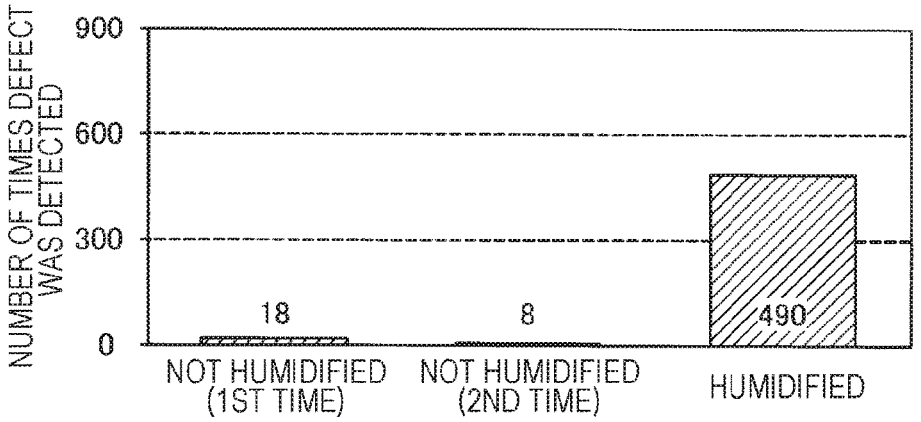
FIG. 10 is a graph showing the results of experiments for determining whether or not a defect can be detected in the case where the humidity in the casing is changed.

FIG. 10 is a graph showing the results of experiments for determining whether or not a defect can be detected in the case where the humidity in the casing 320 is changed. In FIG. 10, the experiment results at the left and center are the results obtained when the space inside the casing 320 was not humidified, and the experiment result at the right is the result obtained when the space inside the casing 320 was humidified. In the experiments, the condition in which the humidity in the pressure resistant vessel 300 is higher than or equal to a predetermined value was realized by placing a small amount of water in the casing 320.

An experimenter used the above-described type A spark plugs, and a voltage of 35 kV was applied to the center electrode 10 nine hundred times. The voltage was applied while the pressure was set to 4 MPa for the first 300 times, while the pressure was reduced from 4 MPa to 0.3 MPa for the next 150 times, and while the pressure was set to 0.3 MPa for the last 450 times.

The results of FIG. 10 show that the number of times the defect was detected was greater when the space inside the casing 320 was humidified than when the space inside the casing 320 was not humidified. Thus, according to the present embodiment, whether or not the insulator 20 has a defect can be more reliably determined. The humidity in the casing 320 is preferably 50% RH or more, more preferably, 70% RH or more, and still more preferably, 90% RH or more.

E. Modifications

E1. First Modification

In the above-described embodiments, it is determined whether the discharge that has occurred is a flash over or a through discharge based on a binarized image obtained by processing a captured image. However, the determination method is not limited to this. The determination may instead be made based on the captured image. More specifically, in the case of a flash over, light is generated between the center electrode 10 and the metal shell 30 (see FIG. 5A). Since the light is generated at the distal side of the insulator 20, the light easily reaches the imaging device 330, and the brightness thereof is relatively high. In contrast, in the case of a through discharge, light is generated between the insulator 20 and the metal shell 30 (see FIG. 6A). Since the light is generated in a region on the proximal side of the distal portion 21 of the insulator 20, the light does not easily reach the imaging device 330, and the brightness thereof is relatively low. Accordingly, the processing device may determine that a flash over has occurred when the average brightness of the captured image is higher than a predetermine value, and that a through discharge has occurred when the average brightness of the captured image is lower than or equal to the predetermined value.

The present invention is not limited to the above-described embodiments and modifications, and may be embodied in various forms without departing from the gist thereof. For example, the technical features of the embodiments and modifications corresponding to the technical features according to the aspects described in the Summary of the Invention section may be replaced or combined as appropriate to solve some or all of the above-described problems or to obtain some or all of the above-described effects. The technical features may also be omitted as appropriate unless they are described as being essential in this specification.

Having described the invention, the following is claimed:

1. A method for manufacturing a spark plug including an insulator having an axial hole that extends through the insulator in a direction of an axial line; a center electrode disposed in the axial hole in such a manner that a distal end of the center electrode projects from a distal portion of the insulator; and a metal shell that is provided on an outer periphery of the insulator so as to cover a periphery of at least a portion of the insulator and that includes a distal portion to which a ground electrode is bonded, the method comprising:

a defect inspection step of placing an assembly of the center electrode, the insulator, and the metal shell in a pressure resistant vessel and determining whether the insulator has a defect by applying a voltage to the center electrode while a pressure in the pressure resistant vessel is changed to a plurality of different pressures, the insulator being determined to have the defect when, during the applying of the voltage to the center electrode, a through discharge occurs that penetrates the insulator; and a bending step of bending the ground electrode toward the center electrode after the defect inspection step.

2. The method for manufacturing the spark plug according to claim 1, wherein the defect inspection step is performed in an atmosphere containing at least one or more inert gases.

3. The method for manufacturing the spark plug according to claim 1, wherein the defect inspection step is a step in which it is determined whether the assembly has a predetermined voltage resistance by applying the voltage to the center electrode while the pressure in the pressure resistant vessel is such that a differentiated value obtained by differentiating the voltage with respect to time is lower than or equal to a threshold, and then the voltage is reduced and it is determined whether the insulator has a defect.

4. The method for manufacturing the spark plug according to claim 1, wherein the defect inspection step is performed while a humidity in the pressure resistant vessel is higher than or equal to a predetermined value.

* * * * *